US010890339B2

(12) United States Patent
Lee et al.

(10) Patent No.: US 10,890,339 B2
(45) Date of Patent: Jan. 12, 2021

(54) CEILING TYPE AIR CONDITIONER AND CONTROLLING METHOD THEREOF

(71) Applicant: LG ELECTRONICS INC., Seoul (KR)

(72) Inventors: Juyoun Lee, Seoul (KR); Soojin Kang, Seoul (KR); Jusu Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 26 days.

(21) Appl. No.: 16/411,287

(22) Filed: May 14, 2019

(65) Prior Publication Data

US 2019/0353357 A1 Nov. 21, 2019

(30) Foreign Application Priority Data

May 15, 2018 (KR) ..... 10-2018-0055505

(51) Int. Cl.
*F24F 1/0047* (2019.01)
*F04D 25/08* (2006.01)
(Continued)

(52) U.S. Cl.
CPC ..... *F24F 1/0047* (2019.02); *F04D 25/088* (2013.01); *F04D 29/563* (2013.01);
(Continued)

(58) Field of Classification Search
CPC ..... F24F 1/0047; F24F 1/0003; F24F 1/0014; F24F 1/0018; F24F 11/67; F24F 11/79;
(Continued)

(56) References Cited

U.S. PATENT DOCUMENTS

2006/0254293 A1 11/2006 Lee et al.
2012/0174608 A1 7/2012 Kumamoto et al.
2018/0038613 A1* 2/2018 Tomohito ..... F24F 1/0014

FOREIGN PATENT DOCUMENTS

EP 1 726 891 11/2006
EP 2 484 986 8/2012
(Continued)

OTHER PUBLICATIONS

Korean Office Action dated Jan. 13, 2020.
(Continued)

*Primary Examiner* — Emmanuel E Duke
(74) *Attorney, Agent, or Firm* — Ked & Associates LLP

(57) ABSTRACT

A method of controlling a ceiling type air conditioner including a panel, a first vane group, and a second vane group, and each of the first and second vane groups including an upper discharge vane and a lower discharge vane includes performing first mixing operation in which the first vane group guides air in a direction close to the ceiling surface to form horizontal airflow and the second vane group guides air in a direction close to a floor surface to form vertical airflow, determining whether swing operation of continuously rotating the first vane group and the second vane group or fixing operation in which the first vane group and the second vane group are located at the same angle is performed, and performing second mixing operation in which the first vane group forms the vertical airflow and the second vane group forms the horizontal airflow.

18 Claims, 10 Drawing Sheets
(4 of 10 Drawing Sheet(s) Filed in Color)

(51) Int. Cl.

| | |
|---|---|
| ***F04D 29/56*** | (2006.01) |
| ***F04D 29/58*** | (2006.01) |
| ***F24F 1/0003*** | (2019.01) |
| ***F24F 1/0014*** | (2019.01) |
| ***F24F 1/0018*** | (2019.01) |

(52) U.S. Cl.
CPC ..... *F04D 29/5833* (2013.01); *F24F 1/0003* (2013.01); *F24F 1/0014* (2013.01); *F24F 1/0018* (2013.01)

(58) Field of Classification Search
CPC .. F24F 13/08; F24F 13/10; F24F 13/14; F24F 13/1413; F24F 13/1426; F04D 25/088; F04D 29/563; F04D 29/5833
See application file for complete search history.

(56) References Cited

FOREIGN PATENT DOCUMENTS

| | | |
|---|---|---|
| EP | 3 130 861 | 2/2017 |
| JP | 1996334255 | 12/1996 |
| KR | 10-2003-0008242 | 1/2003 |
| KR | 10-2004-0065623 | 7/2004 |
| KR | 10-2005-0066463 | 6/2005 |
| KR | 10-2018-0005376 | 1/2018 |
| KR | 10-2018-0037514 | 4/2018 |

OTHER PUBLICATIONS

European Search Report dated Sep. 27, 2019 issued in EP Application No. 191744390.0.
Korean Notice of Allowance dated Jul. 24, 2020 issued in Application No. 10-2018-0055505.

* cited by examiner

FIG. 9

| FACTOR | | AUTO SWING | DYNAMIC AIRFLOW | |
|---|---|---|---|---|
| | | | FIRST OR SECOND MIXING OPERATION | SWING OPERATION |
| VERTICAL TEMPERATURE DISTRIBUTION | 32℃ | 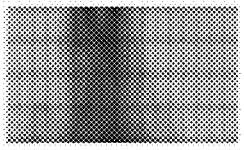 | 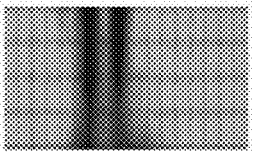 | 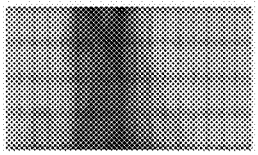 |
| HORIZONTAL (1.1m) TEMPERATURE DISTRIBUTION | 23℃ | 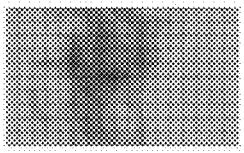 | 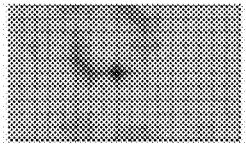 | 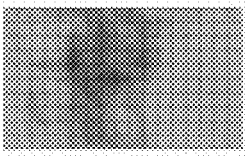 |
| HORIZONTAL (0.1m) TEMPERATURE DISTRIBUTION | | 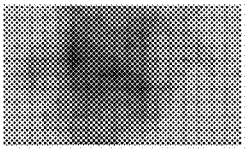 | 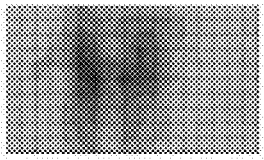 | 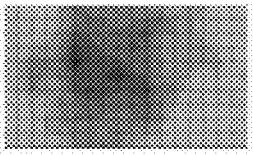 |
| TIME REQUIRED FOR DECREASING BY 1℃ (sec) | | 0:10:45 | 0:10:31 | |
| TIME REQUIRED TO REACH SET TEMPERATURE (sec) | | 0:22:40 | 0:19:02 | |

[EXPERIMENTAL CONDITION: OUTDOOR TEMPERATURE IS 35±0.3℃, INDOOR TEMPERATURE IS 33±0.3℃, SET TEMPERATURE IS 26℃ AND FAN ROTATION SPEED IS 600 RPM]

FIG. 10

| FACTOR | | AUTO SWING | DYNAMIC AIRFLOW | |
|---|---|---|---|---|
| | | | FIRST OR SECOND MIXING OPERATION | FIXING OPERATION P2 |
| VERTICAL TEMPERATURE DISTRIBUTION | 28℃ / 16℃ | 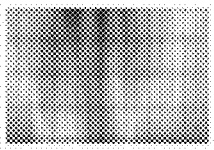 | 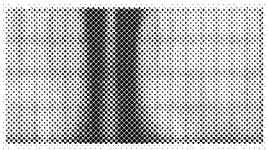 | 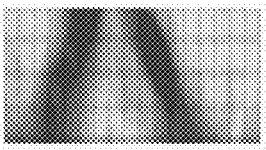 |
| HORIZONTAL (1.1m) TEMPERATURE DISTRIBUTION | | 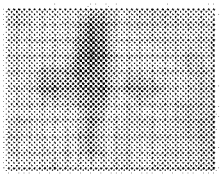 | 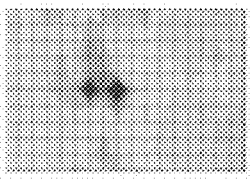 | 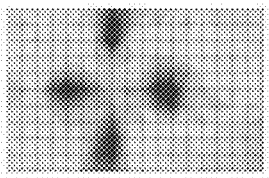 |
| HORIZONTAL (0.1m) TEMPERATURE DISTRIBUTION | | 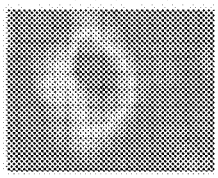 | 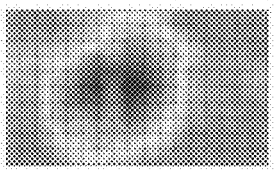 | 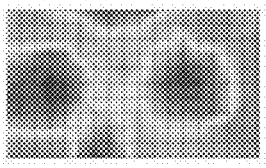 |
| TIME REQUIRED FOR DECREASING BY 1℃ [sec] | | 0:06:46 | 0:06:38 | |
| TIME REQUIRED TO REACH SET TEMPERATURE [sec] | | 0:28:08 | 0:25:29 | |
| TEMPERATURE DIFFERENCE [℃] BETWEEN UPPER AND LOWER PORTIONS (1.1 TO 1.8m) | | 2.3 | 0.7 | |

EXPERIMENTAL CONDITION: OUTDOOR TEMPERATURE IS 7±0.3℃, INDOOR TEMPERATURE IS 12±0.3℃, SET TEMPERATURE IS 23℃ AND FAN ROTATION SPEED IS 670 RPM]

CEILING TYPE AIR CONDITIONER AND CONTROLLING METHOD THEREOF

CROSS-REFERENCE TO RELATED APPLICATIONS

The present application claims priority under 35 U.S.C. 119 and 35 U.S.C. 365 to Korean Patent Application No. 10-2018-0055505 (filed on May 15, 2018) which is hereby incorporated by reference in its entirety.

BACKGROUND

The present invention relates to a ceiling type air conditioner and a method of controlling the same.

An air conditioner is an apparatus for maintaining air of a predetermined space in a best state according to usage or purposes thereof. In general, the air conditioner includes a compressor, a condenser, an expansion device and an evaporator. A freezing cycle for performing compression, condensation, expansion and evaporation of refrigerant may be performed to cool or heat the predetermined space.

The predetermined space may be changed according to place where the air conditioner is used. For example, when the air conditioner is positioned in home or office, the predetermined space may be an indoor space of a house or building.

When the air conditioner performs cooling operation, an outdoor heat exchanger provided in an outdoor unit performs a condensation function and an indoor heat exchanger provided in an indoor unit performs an evaporation function. In contrast, when the air conditioner performs heating operation, the outdoor heat exchanger performs a condensation function and the indoor heat exchanger performs an evaporation function.

The air conditioner may be classified into an upright type, a wall-mounted type or a ceiling type according to the installation position thereof. The upright type air conditioner refers to an air conditioner standing up in an indoor space, and the wall-mounted type air conditioner refers to an air conditioner attached to a wall surface.

In addition, the ceiling type air conditioner is understood as an air conditioner installed in a ceiling. For example, the ceiling type air conditioner includes a casing embedded in a ceiling and a panel coupled to a lower side of the casing and including an inlet and an outlet formed therein.

Information on the related art is as follows.

1. Patent Publication No. (Publication Date): 2003-0008242 (Jan. 25, 2003)

2. Title of the Invention: Vane control method of ceiling type air conditioner

The related art discloses increasing the speed of discharged airflow by alternately performing opening and closing operation of opposing vanes using a plurality of stepping motors.

However, the related art has the following problems.

First, it takes a considerable time for an indoor temperature to reach a target set temperature by airflow discharged by the vanes.

Second, since the length of the guide of the vane for the discharged air is relatively small, the arrival distance of the discharged air is relatively small. Such a problem delays temperature rise of the user's activity area and is insufficient to give the user a pleasant feeling in the heating operation of forming airflow in which relatively warm air rises.

Third, in the related art, the air conditioner is controlled using the same control method in cooling operation and heating operation. Specifically, if the same control as the cooling operation is performed in heating operation, even when relatively warm air is discharged from the ceiling by relatively cold indoor air, warm air flows to a point higher than an occupant (user) according to flow of air due to a temperature difference, thereby decreasing a pleasant feeling and increasing the rising time of an indoor temperature.

Fourth, it is impossible to eliminate the unpleasant feeling of the user due to draft. The draft means a phenomenon wherein local convection current is caused by an indoor thermal environment, that is, a vertical or horizontal temperature difference, even when the appropriate temperature of an indoor floor is maintained in a room in which ventilation occurs.

That is, the temperature and the air velocity of the user's position are changed by draft. As a result, there is a difference between the actual pleasant feeling of the user and the pleasant feeling of the user determined by the conventional air conditioner.

SUMMARY

Embodiments provide a method of controlling a ceiling type air conditioner capable of rapidly satisfying the pleasant feeling of a user. Embodiments provide a ceiling type air conditioner capable of improving a time required to reach a target set temperature in cooling or heating operation, and a method of controlling the same.

Embodiments provide a ceiling type air conditioner capable of performing control according to cooling operation or heating operation in order to enable an indoor temperature to rapidly reach a set temperature in consideration of an indoor environment in which cooling or heating is performed, and a method of controlling the same.

Embodiments provide a ceiling type air conditioner capable of improving a descending distance of discharged airflow in heating operation, and a method of controlling the same.

Embodiments provide a ceiling type air conditioner capable of continuously maintaining the pleasant feeling of a user, and a method of controlling the same.

Embodiments provide a ceiling type air conditioner capable of eliminating the unpleasant feeling of a user caused by draft using an airflow unpleasant feeling index, and a method of controlling the same.

In one embodiment, a ceiling type air conditioner includes a panel located on a ceiling surface, a first vane group located at outlets formed at two opposing sides of four sides of the panel, and a second vane group located at outlets formed at the other two opposing sides of the four sides of the panel, and each of the first vane group and the second vane group includes an upper discharge vane and a lower discharge vane located below the upper discharge vane and rotating along with the upper discharge vane.

A method of controlling a ceiling type air conditioner includes performing first mixing operation in which the first vane group guides air in a direction close to the ceiling surface to form horizontal airflow and the second vane group guides air in a direction close to a floor surface to form vertical airflow, determining whether swing operation of continuously rotating the first vane group and the second vane group or fixing operation in which the first vane group and the second vane group are located at the same angle is performed, and performing second mixing operation in which the first vane group forms the vertical airflow and the second vane group forms the horizontal airflow.

The determining of whether the swing operation of continuously rotating the first vane group and the second vane group or the fixing operation in which the first vane group and the second vane group are located at the same angle is performed may include determining whether cooling operation or heating operation is performed, It is determined that the swing operation is performed when the cooling operation is performed, and it is determined that the fixing operation is performed when the heating operation is performed.

Each of the first vane group and the second vane group may rotate in any one of a plurality of angle groups defined by a first rotation angle of the upper discharge vane and a second rotation angle of the lower discharge vane.

In addition, the first rotation angle may be defined as an angle between a virtual horizontal reference line parallel to the ceiling surface or the floor surface and the upper discharge vane, and the second rotation angle may be defined as an angle between the horizontal reference line and the lower discharge vane.

In addition, the plurality of angle groups may include a first angle group in which the first rotation angle is set to 60° or more and less than 71.1° and the second rotation angle is set to 20° or more and less than 45.6°, a second angle group in which the first rotation angle is set to 71.1° or more and less than 72.3° and the second rotation angle is set to 45.6° or more and less than 53°, a third angle group in which the first rotation angle is set to 72.3° or more and less than 72.7° and the second rotation angle is set to 53° or more and less than 58°, and a fourth angle group in which the first rotation angle is set to 72.7° or more and less than 74° and the second rotation angle is set to 58° or more and less than 71°.

In the first mixing operation, the first vane group may be located in the first angle group and the second vane group may be located in the third angle group, when cooling operation is performed.

In addition, in the first mixing operation, the first vane group may be located in the first angle group and the second vane group may be located in the fourth angle group, when heating operation is performed.

In addition, in the second mixing operation, the first vane group may be located in the third angle group and the second vane group may be located in the first angle group, when cooling operation is performed.

In addition, in the second mixing operation, the first vane group may be located in the fourth angle group and the second vane group may be located in the first angle group, when heating operation is performed.

In addition, the swing operation may be defined as continuous rotation between the first angle group and the third angle group.

In addition, in the fixing operation, the first and second vane groups may be located in the second angle group to guide air.

The method may further include calculating an airflow unpleasant feeling index due to an indoor draft phenomenon.

The air conditioner may further include a fan configured to blow air.

Here, when the calculated airflow unpleasant feeling index is greater than a reference value, a rotation speed of the fan may decrease.

In another aspect, a ceiling type air conditioner includes a panel located on a ceiling surface, a first vane group located at outlets formed at two opposing sides of four sides of the panel, a second vane group located at outlets formed at the other two opposing sides of the four sides of the panel, and a controller configured to control rotation positions of the first vane group and the second vane group.

In addition, each of the first vane group and the second vane group may include an upper discharge vane and a lower discharge vane located below the upper discharge vane and rotating along with the upper discharge vane. That is, the ceiling type air conditioner may include dual vane for guiding air upward and downward from one output.

In addition, the controller may set the rotation positions to any one of a plurality of angle groups defined by a first rotation angle of the upper discharge vane and a second rotation angle of the lower discharge vane.

The ceiling type air conditioner may further include a motor connector located inside the panel and coupled with a discharge motor, a rotation link connected with the discharge motor to rotate, and a slave link coupled to one end of the rotation link, and the slave link may be coupled to the upper discharge vane to guide rotation of the upper discharge vane.

In addition, the rotation link may extend from a rotation center connected with the discharge motor in two directions.

The other end of the rotation link may be coupled with the lower discharge vane.

The motor connector may include a stop projection protruding toward the outlets to restrict rotation of the rotation link.

The present invention has the following effects.

First, it is possible to further shorten a time required for an indoor temperature to reach a target set temperature in cooling or heating operation, by generating dynamic airflow in an indoor space. Therefore, it is possible to improve user's satisfaction with a product.

Second, an indoor temperature can reach a set temperature at a minimum time, by providing upper and lower discharge vanes such that extension surfaces thereof are at optimal angles from a horizontal plane in order to rapidly form dynamic airflow.

Third, it is possible to rapidly give the user a pleasant feeling based on indoor environments which differ between cooling or heating, by performing dynamic airflow operation according to cooling or heating operation. That is, it is possible to provide optimal performance according to cooling operation or a heating operation.

Fourth, since a dual discharge vane structure is applied unlike the existing vane structure, an area for guiding air discharged through the discharge vane can increase and thus discharge airflow can be guided to a relatively long distance.

Fifth, since discharge airflow descending in the heating operation by the dual discharge vane can reach a relative long distance, it is possible to rapidly improve the pleasant feeling of the user activity area in the heating operation environment in which warm air rises.

Sixth, air discharged by the upper discharge vane and the lower discharge vane located at different angles generates swirling airflow in a boundary area between the lower portion of the indoor place and the wall surface, thereby rapidly mixing air.

Seventh, by determining the unpleasant feeling of the user due to draft and performing control to maintain an appropriate pleasant feeling, a user can maintain the pleasant feeling for a long time and a dead zone of airflow can be eliminated.

Eighth, it is possible to minimize draft occurrence, by minimizing a horizontal or vertical temperature difference of a user's position.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIG. 9 is a table showing a result of comparison between general auto swing and a dynamic airflow mode in cooling operation of a ceiling type air conditioner according to an embodiment of the present invention.

FIG. 10 is a table showing a result of comparison between general auto swing and a dynamic airflow mode in heating operation of a ceiling type air conditioner according to an embodiment of the present invention.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s).

Figure 1:
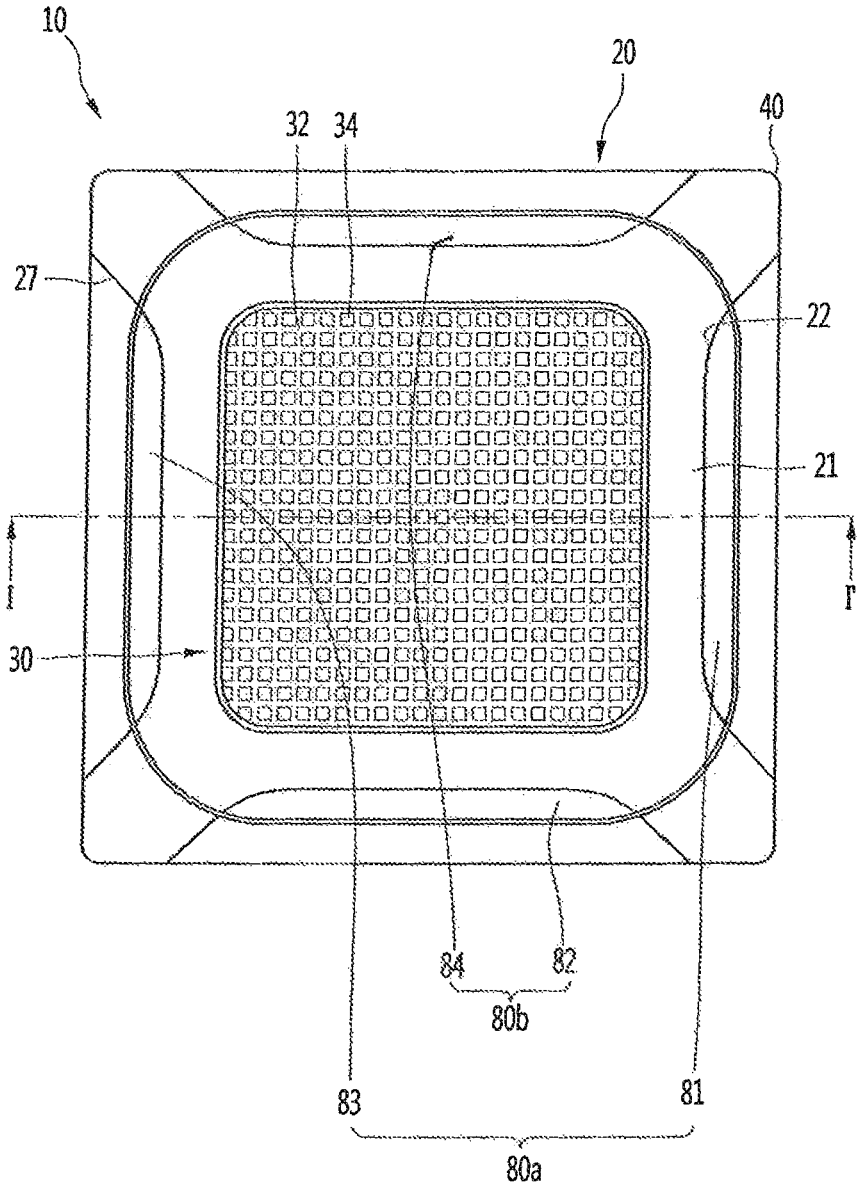
FIG. 1 is bottom view showing the configuration of a ceiling type air conditioner according to an embodiment of the present invention.
Figure 2:
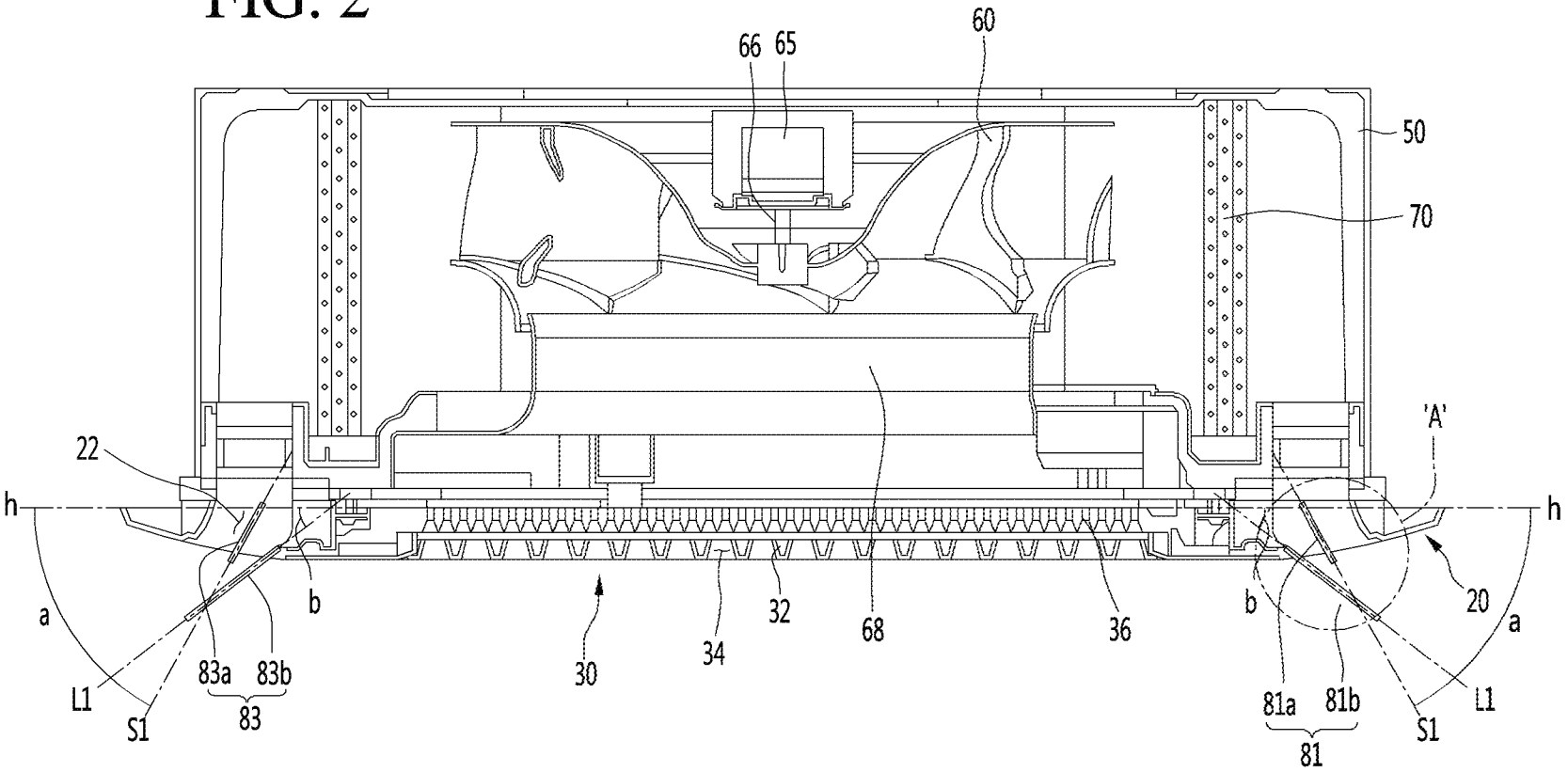
FIG. 2 is a cross-sectional view taken along line I-I' of FIG. 1.

FIG. 1 is bottom view showing the configuration of a ceiling type air conditioner according to an embodiment of the present invention, and FIG. 2 is a cross-sectional view taken along line I-I' of FIG. 1.

Referring to FIGS. 1 to 2, the ceiling type air conditioner 10 (hereinafter referred to as an air conditioner) according to the embodiment of the present invention includes a casing 50 and a panel 20.

The casing 50 is embedded in the internal space of a ceiling and the panel 20 is substantially located at a height of the ceiling to be exposed to the outside. A plurality of parts may be installed in the casing 50.

The plurality of parts includes a heat exchanger 70 for exchanging heat with air sucked into the casing 50. The heat exchanger 70 may be disposed to be bent multiple times along the inner surface of the casing 50 and to surround a fan 60.

The plurality of parts further includes a fan 60 driven for suction and discharge of indoor air and an air guide 68 for guiding air sucked toward the fan 60.

The fan 60 is coupled with a motor shaft 66 of a fan motor 65. The fan 60 may rotate by driving the fan motor 65.

The air guide 68 is disposed at the suction side of the fan 60 to guide air sucked through an inlet 34 toward the fan 60. For example, the fan 60 may include a centrifugal fan.

The panel 20 is mounted on the lower end of the casing 50 and may be substantially formed in a rectangular shape when viewed from the lower side thereof. In addition, the panel 20 may be formed to protrude outward from the lower end of the casing 50 and a circumference thereof may be in contact with a lower surface (ceiling surface) of the ceiling.

The panel 20 includes a panel body 21 and outlets 22, through which air of the internal space of the casing 50 is discharged.

The outlets 22 may be formed by perforating at least a portion of the panel body 21 and may be formed at positions corresponding to four sides of the panel body 21.

That is, the outlets 22 may be formed along the extension directions of the four sides of the panel 20.

Here, the extension direction may be understood as the longitudinal direction of one of the four sides of the panel 20. In addition, the direction perpendicular to the longitudinal direction may be understood as a width direction.

The air conditioner 10 further includes a discharge vane 80 for opening and closing the outlets 22 and a discharge motor 90 for rotating the discharge vane 80.

The discharge vane 80 may be mounted in the panel 20. In addition, the discharge vane 80 may be formed in a shape corresponding to the opening shape of the outlet 22. Accordingly, the discharge vane 80 may open or close the outlets 22 formed at the four sides of the panel 20.

In addition, the discharge vane 80 is provided with two dual guide portions 81*a*, 83*a*, 81*b* and 83*b* for guiding the discharge direction of air passing through the internal space of the casing 50.

The dual guide portions are disposed to be spaced apart from each other in the upward-and-downward direction or in the inward-and-outward direction. The discharge vane 80 may guide air discharged into the indoor space, in which the air conditioner 10 is installed, in directions according to two angles.

Accordingly, since a guide area and length of discharged air are relatively increased, the discharged air can reach up to a longer distance. In particular, it is possible to rapidly increase the temperature of the lower portion of the indoor space corresponding to the user activity area in an environment in which heating is performed.

The upper guide portions of the dual guide portions are defined as upper discharge vanes 81*a* and 83*a* and the lower guide portions thereof are defined as lower discharge vanes 81*b* and 83*b*.

That is, the discharge vane 80 includes the upper discharge vanes 81*a* and 83*a* and the lower discharge vanes 81*b* and 83*b* for guiding the discharged air at set angles.

The upper discharge vanes 81*a* and 83*a* are disposed at the upstream side or inside of the lower discharge vanes 81*b* and 83*b*. Accordingly, the upper discharge vanes 81*a* and 83*a* may also be referred to as internal vanes.

In addition, the lower discharge vanes 81*b* and 83*b* may be downstream side or outside of the upper discharge vanes 81*a* and 83*a*. Accordingly, the lower discharge vanes 81*b* and 83*b* may also be referred to as external vanes.

The upper discharge vanes 81*a* and 83*a* and the lower discharge vanes 81*b* and 83*b* may guide the discharged air at different angles. That is, the direction of the discharged air guided by the upper discharge vanes 81*a* and 83*a* and the direction of the discharge air guided by the lower discharge vanes 81*b* and 83*b* may be different.

For example, air discharged from the upper discharge vanes 81*a* and 83*a* may be discharged to the upper side of the indoor space than air discharged from the lower discharge vanes 81*b* and 83*b*.

In addition, the lower discharge vanes 81*b* and 83*b* may be formed to have a larger area of an air guide surface than the upper discharge vanes 81*a* and 83*a*. That is, the lower discharge vanes 81*b* and 83*b* may extend to have a greater width than the upper discharge vanes 81*a* and 83*a*.

In other words, the lower discharge vanes 81*b* and 83*b* may be formed to have a larger length than the upper discharge vanes 81*a* and 83*a* in the discharge direction of air.

Accordingly, air discharged from the lower discharge vanes 81*b* and 83*b* may reach a farther position than air discharged from the upper discharge vanes 81*a* and 83*a*. Accordingly, in particular, in the heating operation, the discharged air guided by the lower discharge vanes 81*b* and 83*b* flows in a relatively long distance, thereby providing warm air to the floor surface.

In addition, since it is possible to provide warm air to the floor surface, in which cold air is mainly distributed, with a relative large flow rate, although ascending airflow is formed, it is possible to rapidly increase the temperature of the indoor space in the area defined from the floor surface to the height of the user as the user activity area.

In addition, the air discharged by the upper discharge vanes 81*a* and 83*a* and the lower discharge vanes 81*b* and 83*b* form swirling airflow by a wind speed, density, a temperature difference, thereby facilitating mixing of indoor air. Therefore, the indoor temperature can rapidly increase in the heating operation.

In addition, the upper discharge vanes 81*a* and 83*a* and the lower discharge vanes 81*b* and 83*b* may extend to form a curved surface toward the air discharge direction.

The discharge vane 80 includes a first discharge vane 81, a second discharge vane 82, a third discharge vane 83 and a fourth discharge vane 84 capable of opening and closing the outlets 22 formed along the four sides of the panel 20.

Each of the first to fourth discharge vanes 80 includes the upper discharge vanes 81*a* and 83*a* and the lower discharge vanes 81*b* and 83*b*. That is, each of the first to fourth discharge vanes 80 includes dual guide portions.

Specifically, referring to FIG. 2, the first discharge vane 81 includes the upper discharge vane 81*a* and the lower discharge vane 81*b*. The third discharge vane 83 includes the upper discharge vane 83*a* and the lower discharge vane 83*b*. Although not shown in FIG. 2, each of the second discharge vane 82 and the fourth discharge vane 84 includes the upper discharge vane and the lower discharge vane.

The first discharge vane 81 and the third discharge vane 83 are positioned in directions opposite to each other. The second discharge vane 82 and the fourth discharge vane 84 are positioned in directions opposite to each other.

The first vane 81 and the third discharge vane 83 may be positioned perpendicular to the second discharge vane 82 and the fourth discharge vane 84.

In FIG. 1, the first discharge vane 81 is spaced apart from the third discharge vane 83 in a horizontal direction and the second discharge vane 82 is spaced apart from the fourth discharge vane 83 in a vertical direction. That is, the first discharge vane 81 and the third discharge vane 83 are provided to open and close the outlets 22 formed in the vertical direction and the second discharge vane 82 and the fourth discharge vane 84 are provided to open and close the outlets 22 formed in the horizontal direction.

The first discharge vane 81 and the third discharge vane 83 rotate at the same angle. In addition, the second discharge vane 82 and the fourth discharge vane 84 rotate at the same angle.

Here, the first discharge vane 81 and the third discharge vane 83 are defined as a first vane group and the second discharge vane 82 and the fourth discharge vane 84 are defined as a second vane group.

That is, the first vane group may include the first discharge vane 81 and the third discharge vane 83 for opening and closing the outlets 22 located at two opposing sides, and the second vane group may be located perpendicular to the first vane group and include the second discharge vane 82 and the fourth discharge vane for opening and closing the outlets 22 located at the other two opposing sides.

Referring to FIG. 2, a virtual horizontal line parallel to the ground forming a horizontal surface or a ceiling surface, on which the panel 20 is mounted, and passing through the rotation center of the third discharge vane 83 and the rotation center of the first discharge vane 81 is defined as a horizontal reference line h.

For example, the horizontal reference line h may be parallel-moved in the upward-and-downward direction, thereby determining the rotation angle of the upper discharge vane or the lower discharge vane.

In addition, virtual straight lines drawn along the width direction of the discharge vane 80, that is, the longitudinal section of the discharge vane 80, are defined as extension lines L1 and S1.

The extension lines include the upper extension line S1 which is the virtual straight line drawn along the longitudinal sections of the upper discharge vanes 81*a* and 83*a* and the lower extension line L1 which is the virtual straight line drawn along the longitudinal sections of the lower discharge vanes 81*b* and 83*b*.

Accordingly, an angle a between the horizontal reference line h and the upper extension line S1 may be understood as the rotation angles of the upper discharge vanes 81*a* and 83*a*, and an angle b between the horizontal reference line h and the lower extension line L1 may be understood as the rotation angles of the upper discharge vanes 81*b* and 83*b*.

Meanwhile, as described above, in the first discharge vane 81 and the third discharge vane 83 configuring the first vane group, the angles a between the horizontal reference line h and the extension lines S1 of the upper discharge vanes 81*a* and 83*a* may be the same.

Similarly, in the first vane group, the angles b between horizontal reference line h and the extension lines L1 of the lower discharge vanes 81*b* and 83*b* may be the same.

The angle between the horizontal reference line h and extension lines S1 of the upper discharge vanes 81*a* and 83*a* is referred to as a first rotation angle a and the angle between the horizontal reference line h and the extension lines L1 of the lower discharge vanes 81*b* and 83*b* is referred to as a second rotation angle b.

The rotation range of the upper discharge vanes 81*a* and 83*a* may be less than that of the lower discharge vanes 81*b* and 83*b*.

That is, the range of the first rotation angle a may be less than that of the second rotation angle b. For example, the range of the first rotation angle a may be set to 60° to 74°, and the range of the second rotation angle b may be set to 20° to 71°.

However, since the upper discharge vanes 81*a* and 83*a* and the lower discharge vanes 81*b* and 83*b* rotate according to rotation of one discharge motor 90 as a link motion structure, the second rotation angle b may be less than the first rotation angle a.

That is, the first rotation angle a may be always greater than the second rotation angle b. For example, when the first rotation angle a is 30°, the second rotation angle may be set to 67°.

Meanwhile, the second vane group 82 and 84 is positioned perpendicular to the first vane group 81 and 83 and has the same configuration as the first vane group 81 and 83.

That is, the description of the horizontal reference line h and the extension lines S1 and L1 of the first vane group 81 and 83 is applicable to the second vane group 82 and 84 perpendicular to the first vane group.

Accordingly, similarly to the first vane group 81 and 83, the rotation angle of the upper discharge vanes of the second vane group 82 and 84 may be defined as the first rotation angle a and the rotation angle of the lower discharge vanes of the second vane group 82 and 84 may be defined as the second rotation angle b.

However, the rotation angle of the first vane group 81 and 83 may be different from the rotation angle of the second vane groups 82 and 84. This will be described in detail below.

The discharge motor 90 may be connected to the discharge vane 80 to provide power. In addition, the discharge motor 90 may rotate the discharge vane 80 and the outlets 22 may be opened and closed by rotation of the discharge vane 80. For example, a plurality of discharge motors 90 may be provided to be connected to the discharge vanes 81, 82, 83 and 84.

In addition, the discharge motor 90 may include a step motor.

A suction grill 30 is mounted at the center of the panel 20. The suction grill 30 forms the lower appearance of the air conditioner 10 and has a substantially rectangular frame shape.

The suction grill 30 includes a grill body 32 having a grid shape and including an inlet 34. A filter member 36 for filtering air sucked through the inlet 34 is provided on the grill body 32. For example, the filter member 36 may have a substantially rectangular frame shape.

The outlets 22 may be disposed outside the suction grill 30 in four directions. For example, the outlets 22 may be provided outside the inlet 34 in the up, down, left and right directions. By disposing the inlet 34 and the outlets 22, air of the indoor space is sucked into and conditioned in the casing 50 by the central portion of the panel 20, and the conditioned air may be discharged through the outlets 22 to the outside of the panel 20 in four directions.

Cover mounting portions 27 are formed at four corners of the panel body 21. The cover mounting portions 27 may be formed by perforating at least a portion of the panel body 21. The cover mounting portions 27 are used to check the services of the plurality of parts mounted on the rear surface of the panel 20 or operation of the air conditioner 10 and may be configured to be opened or closed by the cover member 40.

Air flow in the air conditioner 10 will be briefly described. When the fan motor 65 is driven to generate rotation force in the fan 60, air of the indoor space is sucked through the inlet 34 and is filtered by the filter member 36. The sucked air flows to the fan 60 through the inner space of the air guide 68 and the flow direction of air is changed through the fan 60.

Air sucked through the inlet 34 flows upward, flows into the fan 60, and flows to the outside through the fan 60. Air passing through the fan 60 is heat-exchanged through the heat exchanger 70 and the heat-exchanged air flows downward, thereby being discharged through the outlets 22.

That is, air is sucked through the suction grill 30 located at the center of the panel 20 and is discharged through the outlets 34 after flowing from the casing 50 toward the outside of the suction grill 30.

As described above, the upper discharge vanes 81*a* and 83*a* and the lower discharge vanes 81*b* and 83*b* are linked by a plurality of links to rotate. Therefore, the upper discharge vanes 81*a* and 83*a* and the lower discharge vanes 81*b* and 83*b* rotate by one discharge motor 90.

Hereinafter, the connection and rotation structure of the upper discharge vanes 81*a* and 83*a* and the lower discharge vanes 81*b* and 83*b* will be described in detail.

Figure 3:
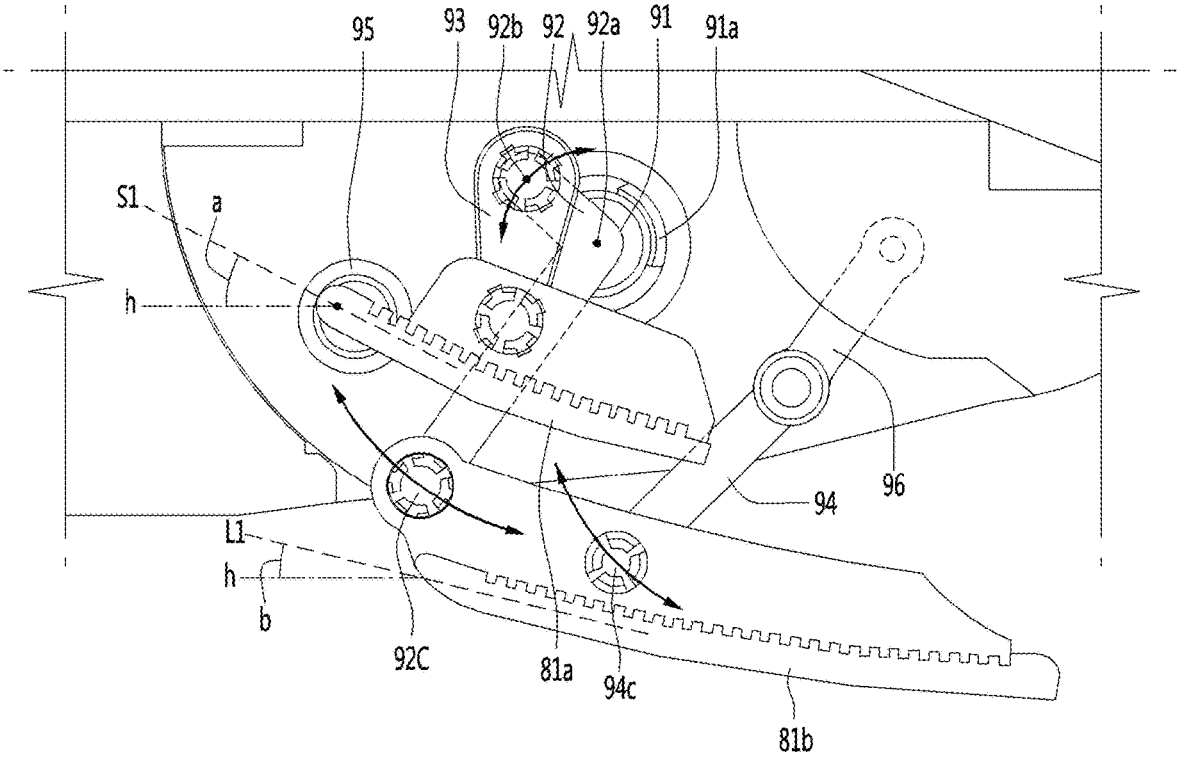
FIG. 3 is a partial enlarged view of "A" of FIG. 2.

FIG. 3 is a partial enlarged view of "A" of FIG. 2. FIG. 3 shows the connection state and rotation operation of the upper discharge vane 81*a* and the lower discharge vane 81*b* based on the first discharge vane 81. However, since the first discharge vane 81 to the fourth discharge vane 84 are different from each other in arrangement or formation position but are equal to each other in the configuration, for the upper discharge vanes and the lower discharge vanes of the second discharge vane 82, the third discharge vane 83 and the fourth discharge vane 84, refer to the description of the upper discharge vane 81*a* and the lower discharge vane 81*b* of the first discharge vane 81.

Referring to FIG. 3, the air conditioner 10 further includes a motor connector 91 coupled with the discharge motor 90, a rotation link 92 connected with the discharge motor 90 coupled to the motor connector 91 and capable of rotating, and a slave link 93 coupled to one end of the rotation link 92 to guide rotation of the upper discharge vane 81*a*.

The motor connector 91 may be provided inside the panel 20. For example, the motor connector 91 may be located on the inner surface of the panel body 21 in which the outlet 22 is formed.

The motor connector 91 may be coupled with the discharge motor 90 at one side thereof. The rotation shaft of the discharge motor 90 may extend in the direction of the outlet 22 through the motor connector 91.

The rotation shaft of the discharge motor 90 may be coupled to the rotation center 92*a* of the rotation link 92. Accordingly, the rotation link 92 may rotate about the rotation center 92*a* according to rotation of the discharge motor 90.

The motor connector 91 includes a stop projection 91*c* for restricting rotation of the rotation link 92. The stop projection 91*c* may be formed to protrude in the direction of the outlet 22 along a portion of the circumference of the motor connector 91.

The stop projection 91*c* may restrict rotation of the rotation link 92 when the lower discharge vane 81*b* reaches a position where the outlet 22 is closed, such that the lower discharge vane 81*b* no longer rotates.

That is, the rotation link 92 is provided such that the rotation shaft of the discharge motor 90 is coupled to the rotation center 92*a*. Accordingly, the rotation link 92 may rotate clockwise or counterclockwise with respect to the rotation center 92*a* by rotation of the discharge motor 90.

A first rotation shaft 92*b* coupled with the slave link 93 is formed on one end of the rotation link 92, and a second rotation shaft 92*c* coupled with the lower discharge vane 81*b* is formed on the other end of the rotation link 92.

The second rotation shaft 92*c* rotates according to rotation of the discharge motor 90 (see an arrow), and thus the lower discharge vane 81*b* receives force and rotates in the upward-and-downward direction to open and close the outlet 22.

The second rotation shaft 92*c* is coupled to one end of the lower discharge vane 81*b*. At this time, the second rotation shaft 92*c* is coupled with an upstream end of the lower discharge vane 81*b* where the discharge air is first brought into contact therewith and guided.

In addition, the lower discharge vane 81*b* may be connected to the panel 20 by a second fixing shaft 96. The second fixing shaft 96 may be formed at one side of the panel 20 to extend toward the outlet 22.

In addition, a guide link 94 rotatably coupled to the second fixing shaft 96 may be connected to the center of the lower discharge vane 81*b* to guide upward and downward rotation of the lower discharge vane 81*b*.

That is, the guide link 94 may be coupled to the lower discharge vane 81*b* at the downstream side of the second rotation shaft 92*c* in the air discharge direction.

Therefore, the lower discharge vane 81*b* may rotate to open and close the outlet 22 according to rotation of the rotation link 92. At this time, the second rotation angle b of the lower discharge vane 81*b* may be determined according to the rotation degree of the rotation link 92, that is, the rotation angle of the discharge motor 90.

Similarly, the first rotation shaft 92*b* rotates according to rotation of the discharge motor 90 (see an arrow) and thus the slave link 93 coupled to the first rotation shaft 92*b* rotates, thereby guiding rotation of the upper discharge vane 81*a*. For example, when the first rotation shaft 92*b* rotates counterclockwise, the slave link 93 may move according to rotation of the first rotation shaft 92*b* to transmit force such that the upper discharge vane 81*a* rotates upward or downward.

A hole for coupling of the first rotation shaft 92*b* is formed in one side of the slave link 93 and a protrusion for coupling to the upper discharge vane 81*b* is formed on the other side of the slave link 93.

The upper discharge vane 81*a* is coupled to be fixed to the panel 20 by the first fixing shaft 95 and the first fixing shaft 95 becomes the rotation center of the upper discharge vane 81*a*. Accordingly, the upper discharge vane 81*a* may rotate about the first fixing shaft 95 in the upward-and-downward direction by force received from the slave link 93.

That is, the upper discharge vane 81*a* may rotate according to rotation of the rotation link 92. At this time, the first rotation angle a of the upper discharge vane 81*b* may be determined according to the rotation degree of the rotation link 92, that is, the rotation angle of the discharge motor 90.

Since the width of the upper discharge vane 81*a* located inside the outlet 22 is less than that of the lower discharge vane 81*b*, the upper discharge vane 81*a* needs to minimize flow resistance against the discharged air and to secure the rotation angle. Accordingly, the upper discharge vane 81*a* is not directly coupled to the rotation link 92 but is connected to the rotation link 92 through the slave link 93.

Similarly, the rotation link 92 may be formed such that a distance r1 from the rotation center 92*a* to the first rotation shaft 92*b* is less than a distance r2 from the rotation center 91*c* to the second rotation shaft 92*c*.

That is, the rotation link 92 may be formed such that a length from the rotation center 92*c* to the slave link 93 is greater than a length from the rotation center 92*c* to the lower discharge vanes 81*b* and 83*b*.

For example, the rotation link 92 may extend in two directions to form a predetermined angle from the rotation center 92*a*. That is, the rotation link 92 may be formed as a frame having a "]" shape or a "[" shape. At this time, the rotation center 91*c* may be located at the center of the bending portion of the rotation link 92.

The distance r1 from the rotation center 91*c* to the first rotation shaft 92*b* of the slave link 83 and the distance r2 from the rotation center 91*c* to the second rotation shaft 92*c* may be understood as rotation radii. Accordingly, the first rotation angle a may be less than the second rotation angle b by rotation of the rotation link 92.

That is, when the discharge motor 90 rotates by a predetermined angle, the second rotation angle b may be changed to be greater than the first rotation angle a. For example, when the discharge motor 90 rotates by 10°, the first rotation angle a may be 4.7° and the second rotation angle b may be 20.5°.

Figure 4:
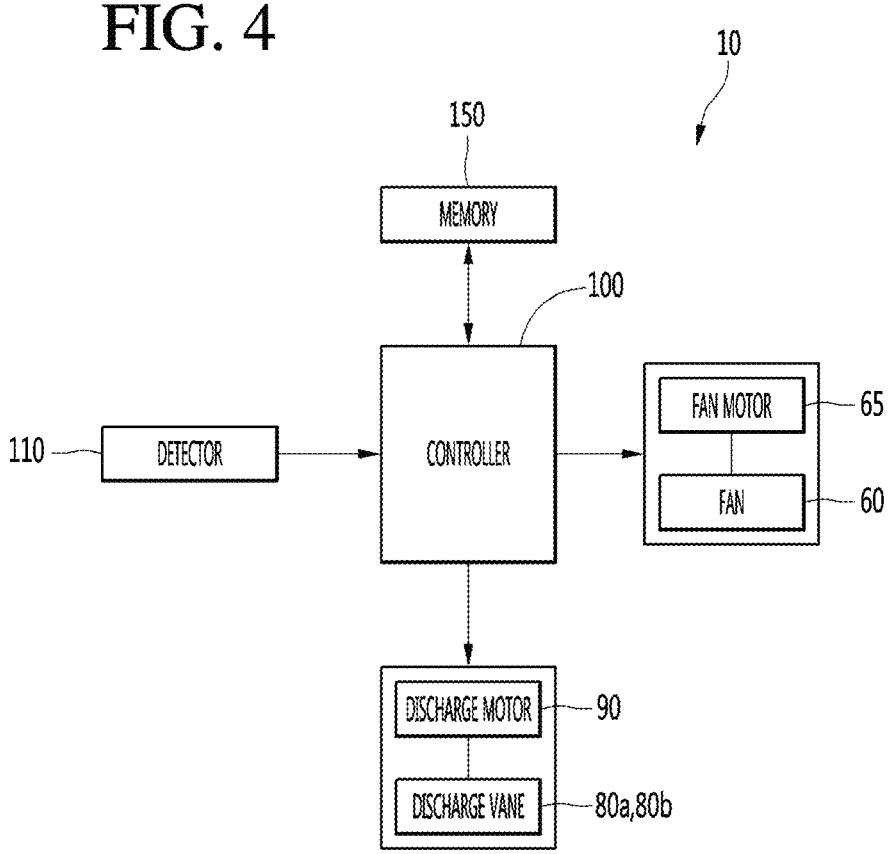
FIG. 4 is a block diagram showing the configuration of a ceiling type air conditioner according to an embodiment of the present invention.

FIG. 4 is a block diagram showing the configuration of a ceiling type air conditioner according to an embodiment of the present invention.

Referring to FIG. 4, the air conditioner 10 further includes a controller 100 for controlling the fan motor 65 and the discharge motor 90.

The controller 100 may control the fan motor 65 in order to control an air volume or a wind speed. Accordingly, the controller 100 may control rotation of the fan 60 connected to the fan motor 65.

In addition, the controller 100 may control rotation of the discharge motor 90. For example, the controller 100 may control rotation of the discharge vane 80, that is, the upper discharge vane and the lower discharge vane, by controlling the rotation angle or the rotation direction of the discharge motor 90.

In addition, the controller 100 may control the first rotation angle a and the second rotation angle b of the first vane group 81 and 83 and the first rotation angle a and the second rotation angle b of the second vane group 82 and 84, by controlling the discharge motor 90 connected to the discharge vanes 80 provided in the outlets 22 corresponding to the four sides of the panel 20. That is, the controller 100 may control the rotation angles of the first vane group 81 and 83 and the second vane group 82 and 84.

As described above, the upper discharge vane and the lower discharge vane configuring any one discharge vane 80 may be linked to each other to rotate by one discharge motor 90.

Accordingly, the ranges of the first rotation angle a and the second rotation angle b may be determined by the rotation angle of the discharge motor 90.

In Table 1 below, the ranges of the first rotation angle a and the second rotation angle b determined according to the rotation angle range of the discharge motor 90 (the step motor) are defined as a first angle group P1, a second angle group P2, a third angle group P3 and a fourth angle group P4.

That is, the first to fourth angle groups may be defined as the ranges of the first rotation angle of the upper discharge vane and the second rotation angle b of the lower discharge vane.

TABLE 1

| | First angle group (P1) | Second angle group (P2) | Third angle group (P3) | Fourth angle group (P4) |
|---|---|---|---|---|
| Rotation angle of the discharge motor 90 | 84°~103.5° | 103.5°~105.7° | 105.7°~107° | 107°~111° |
| First rotation angle(a) | 60°~71.1° | 71.1°~72.3° | 72.3°~72.7° | 72.7°~74° |
| Second rotation angle (b) | 20°~45.6° | 45.6°~53° | 53°~58° | 58°~71° |

Referring to Table 1, the first rotation angle a of the first angle group P1 is defined as a value of 60° or more and less than 71.1° and the second rotation angle b thereof is defined as a value of 20° or more and less than 45.6°. For example, in order to generate optimal dynamic airflow, the first rotation angle a of the first angle group P1 may be set to 67° and the second rotation angle b thereof may be set to 30°.

The first rotation angle a of the second angle group P2 is defined as a value of 71.1° or more and less than 72.3° and the second rotation angle b thereof is defined as a value of 45.6° or more and less than 53°. For example, in order to generate optimal dynamic airflow, the first rotation angle a of the second angle group P2 may be set to 71.7° and the second rotation angle b thereof may be set to 50.5°.

The first rotation angle a of the third angle group P3 is defined as a value of 72.3° or more and less than 72.7° and the second rotation angle b thereof is defined as a value of 53° or more and less than 58°. For example, in order to generate optimal dynamic airflow, the first rotation angle a of the third angle group P3 may be set to 72.2° and the second rotation angle b thereof may be set to 55.5°.

The first rotation angle a of the fourth angle group P4 is defined as a value of 72.7° or more and less than 74° and the second rotation angle b thereof is defined as a value of 58° or more and less than 71°. For example, in order to generate optimal dynamic airflow, the first rotation angle a of the fourth angle group P4 may be set to 72.8° and the second rotation angle b thereof may be set to 60.5°.

The controller 100 may perform control such that the rotation angles of the first vane group 81 and 83 and the second vane group 82 and 84 belong to any one of the first to fourth angle groups P1, P2, P3 and P4.

For example, the controller 100 may control the first rotation angle a and second rotation angle b of the first vane group 81 and 83 in the first angle group P1 and control the first angle a and second rotation angle b of the second vane group 82 and 84 in the third angle group P3.

For example, when the first rotation angle a of the first vane group 81 and 83 is set to 67° and the second rotation angle b thereof is set to 30°, the upper discharge vanes 81*a* and 83*a* and the lower discharge vanes 81*b* and 83*b* may rotate to be located at the set first and second rotation angles, respectively.

Meanwhile, the air conditioner 10 further includes a detector 110 capable of detecting a distance, a temperature of an indoor space, and presence/absence of an occupant.

The detector 110 may include a distance detection sensor provided on the front surface of the panel 20 and a temperature detection sensor for detecting an indoor temperature.

The temperature detection sensor may detect and transmit the indoor temperature to the controller 100. Accordingly, the controller 100 may determine whether to reach a target temperature set by the user based on the result of detection.

The air conditioner 10 further includes a memory for storing data.

The memory 150 may store predetermined information for operation of the air conditioner. In addition, the controller 100 may transmit and receive data to and from the memory 150. Accordingly, the controller 100 may read and written data from and in the memory 150.

Figure 5:
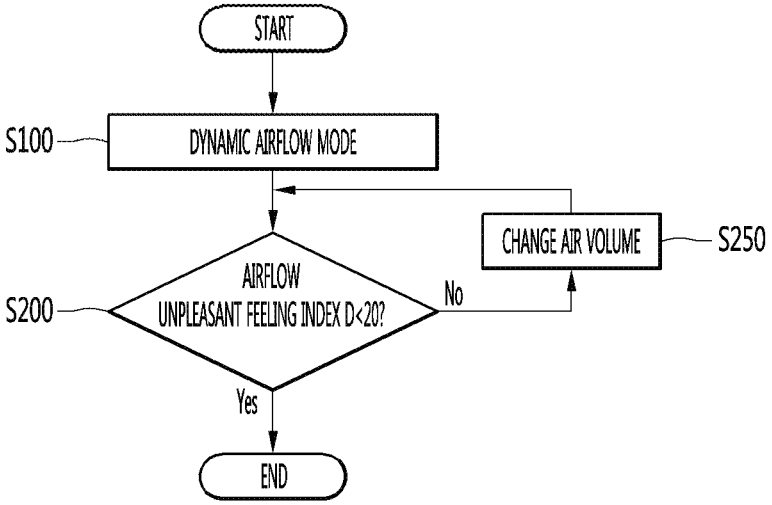
FIG. 5 is a flowchart illustrating a method of controlling a ceiling type air conditioner according to an embodiment of the present invention.

FIG. 5 is a flowchart illustrating a method of controlling a ceiling type air conditioner according to an embodiment of the present invention.

Referring to FIG. 5, the air conditioner 10 according to the embodiment of the present invention may operate in a dynamic airflow mode in an indoor environment in which cooling operation or heating operation is performed (S100).

The dynamic airflow mode may be understood as an operation mode in which the indoor temperature of a space where the air conditioner 10 is installed rapidly reaches a temperature set by the user.

The user may select the dynamic airflow operation during the cooling operation in order to rapidly decrease the indoor temperature in the summer using an operation unit such as a remote controller or a touch panel. At this time, the controller 100 may receive a signal from the operation unit and control the air conditioner 10 to perform the dynamic airflow mode (S100).

The dynamic airflow mode S100 will be described below in detail.

The air conditioner 10 according to the embodiment of the present invention may perform operation for satisfying or maintaining the pleasant feeling of the user, when the indoor temperature reaches the (target) temperature set by the user (occupant) by the dynamic airflow mode (S100).

Specifically, when the indoor temperature reaches the set temperature by the dynamic airflow mode S100, the air conditioner 10 may calculate the airflow unpleasant feeling index D and control the airflow unpleasant feeling index D to be less than a reference value. Here, the reference value of the airflow unpleasant feeling index D may be set to 20 (S200).

The airflow unpleasant feeling index D represents a degree of draft of giving an unpleasant feeling to the user as local convection generated by the above-described vertical or horizontal temperature difference.

The airflow unpleasant feeling index D may be calculated by an indoor temperature Ta (unit: ° C.), an average air velocity v (unit: m/s), and a turbulence intensity Tu (unit: %) as variables. The turbulence intensity Tu is obtained by dividing an interval standard deviation by the average air velocity v.

Equation 1 below is an equation of calculating the airflow unpleasant feeling index D.

$$\text{airflow unpleasant feeling index}(D)=([34-Ta]*[v-0.05]^{0.62})*(0.37*v*Tu+3.14) \quad \text{Equation 1}$$

When the airflow unpleasant feeling index D is greater than 20, the user is defined as causing unpleasantness by the draft phenomenon.

When the airflow unpleasant feeling index D is greater than 20, the controller 100 may change the air volume such that the airflow unpleasant feeling index D has a value of 20 or less. That is, the controller 100 may control the fan motor 65 to change the air volume.

Since the air volume (unit: CMM) is equal to a product of the discharge cross-sectional area (m^2) and a flow rate (m/min), when the controller 100 changes the air volume, the average air velocity v may be changed to decrease the airflow unpleasant feeling index D. For example, the controller 100 may decrease the average air velocity v, by controlling the air volume to be less than a current air volume.

Accordingly, it is possible to minimize or prevent a draft phenomenon in which local convection is caused to give the user an unpleasant feeling.

Figure 6:
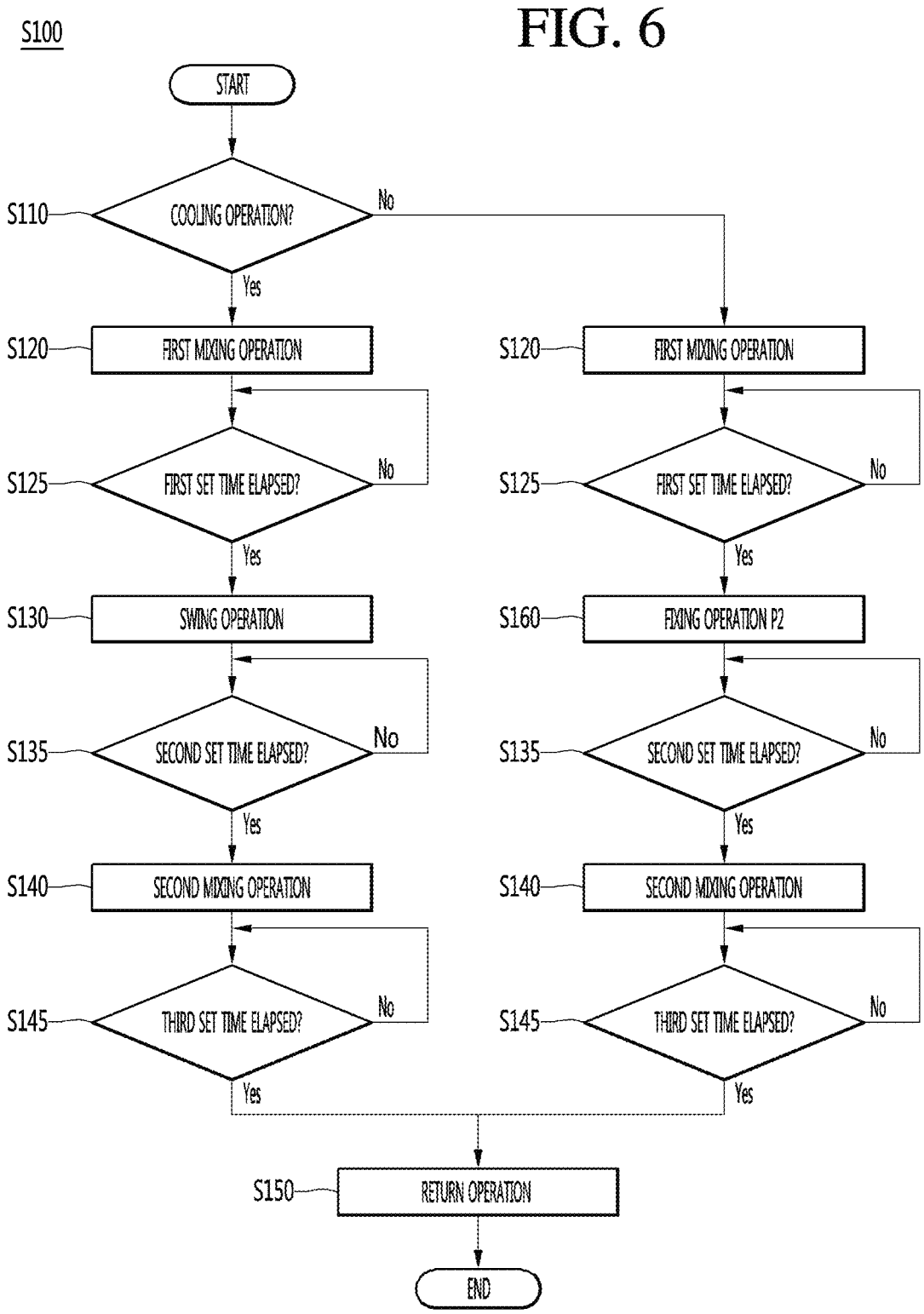
FIG. 6 is a flowchart illustrating a control method for dynamic airflow generation of a ceiling type air conditioner according to an embodiment of the present invention.

FIG. 6 is a flowchart illustrating a control method for dynamic airflow generation of a ceiling type air conditioner according to an embodiment of the present invention. Specifically, FIG. 6 is a flowchart illustrating a detailed control method of the dynamic airflow mode of FIG. 4.

Referring to FIG. 6, the air conditioner according to the embodiment of the present invention may determine whether cooling operation is performed (S110) in the dynamic airflow mode S100.

As described above, an indoor environment in which the air conditioner 10 is installed may have environmental conditions which differ between the heating operation and the cooling operation. For example, when the heating operation is performed, warm air rises by relatively cold indoor air. Accordingly, a temperature rising time increases at the user activity area where warmth or a pleasant feeling may be substantially provided.

Accordingly, the controller 100 may first determine whether the air conditioner 10 performs cooling operation or heating operation (S110) when entering the dynamic airflow mode S100 and perform control to generate optimal dynamic airflow reflecting the indoor environmental conditions according to the cooling or heating operation.

That is, the air conditioner 10 according to the embodiment of the present invention may generate optimal dynamic airflow suitable for the indoor environment according to the cooling operation or the heating operation. Therefore, the indoor temperature can rapidly reach the temperature set by the user.

When the air conditioner 20 performs cooling operation, the air conditioner 10 may perform first mixing operation (S120).

Specifically, when the first mixing operation is performed, the controller 100 controls the first vane group 81 and 83 in the first angle group P1 and controls the second vane group 82 and 84 in the third angle group P3.

Meanwhile, since cold air forms descending airflow in an indoor environment in which cooling operation is performed, in the first mixing operation, the second vane group 82 and 84 may be controlled in the third angle group P3 rather than in the fourth angle group P4. Accordingly, the indoor temperature can more rapidly decrease.

In the first mixing operation, airflow generated by air discharged from the first vane group 81 and 83 flows toward the upper side of the indoor space relatively closer to the ceiling surface and airflow generated by air discharged from the second vane group 82 and 84 flows toward the lower side of the indoor space relatively closer to the floor surface.

At this time, airflow generated by air discharged from the first vane group 81 and 83 is referred to as horizontal airflow and airflow generated by air discharged from the second vane group 82 and 84 is referred to as vertical airflow.

In summary, in the first mixing operation, horizontal airflow guided in bilateral directions of the indoor space through the first vane group 81 and 83 flows along the upper side of the indoor space close to the ceiling surface and vertical airflow guided in the forward-and-backward direction perpendicular to bilateral directions of the indoor space through the second vane group 82 and 84 flows along the lower side of the indoor space close to the floor surface.

In addition, the horizontal airflow and the vertical airflow are mixed by an indoor structure (a wall surface, etc.). For example, horizontal airflow descending along both walls of the indoor space and vertical airflow spreading from the center of the floor surface in the radial direction are mixed, thereby decreasing the indoor temperature (see FIG. 7).

Thereafter, the air conditioner 10 may perform the first mixing operation for a predetermined first set time (S125).

Specifically, the controller 100 may determine whether a time when the first mixing operation is performed exceeds the first set time. For example, the first set time may be set to 5 minutes.

When the first set time has elapsed, the air conditioner 10 may perform swing operation (S130).

Specifically, when the swing operation is performed, the controller 100 may rotate the first vane group 81 and 83 to reciprocate between the first angle group P1 and the third angle group P3. In addition, the controller 100 may rotate the second vane group 82 and 84 to reciprocate between the third angle group P3 and the first angle group P1.

That is, in the swing operation, the first vane group 81 and 83 and the second vane group 82 and 84 may continuously rotate to reciprocate between the first angle group P1 and the third angle group P3 set in the first mixing operation.

Meanwhile, through the first mixing operation, the temperature of an indoor delay space in which the horizontal airflow or the vertical airflow does not arrive or the arrival time of the horizontal airflow or the vertical airflow is delayed may be relatively slowly decreased.

According to the swing operation, since a mixing range of the vertical airflow and the horizontal airflow is widened, it is possible to more rapidly decrease the temperature of the indoor delay space.

Thereafter, the air conditioner 10 may perform the swing operation for a predetermined second set time.

Specifically, the controller 100 may determine whether the execution time of the swing operation has exceeded a predetermined second set time (S135).

For example, the second set time may be set to 5 minutes.

Meanwhile, in the first mixing operation, since the first vane group 81 and 83 guides air in a lateral direction and the second vane group 82 and 84 guides air in an upward-and-downward direction, a dead zone may be formed in a forward-and-backward direction of the indoor space perpendicular to the lateral direction despite the swing operation. The temperature of the dead zone may be lowered more slowly than that of the other indoor space.

That is, in order for the temperature of the dead zone, which is not covered by the first mixing operation and the swing operation, to rapidly reach the set temperature, the air conditioner 10 may perform second mixing operation when the second set time has elapsed (S140).

Specifically, when the second mixing operation is performed, the controller 100 controls the first vane group 81 and 83 in the third angle group P3 and controls the second vane group 82 and 84 in the first angle group P1.

In the second mixing operation, the first vane group 81 and 83 may be located in the third angle group P3 to guide air discharged through the outlet 22 downward toward the floor surface, thereby forming the vertical airflow. The second vane group 82 and 84 may be located in the first angle group P1 to guide air discharged through the outlet 22 to become close to the ceiling surface in the forward-and-backward direction, thereby forming the horizontal airflow.

According to the second mixing operation, the first vane group 81 and 83 and the second vane group 82 and 84 operate in a state in which the rotation angles in the first mixing operation are exchanged with each other, thereby eliminating the dead zone. That is, the indoor temperature of the dead zone which is not covered by the first mixing operation and the swing operation may be rapidly decreased through the second mixing operation.

The air conditioner 10 may perform the second mixing operation for a predetermined third set time (S145).

Specifically, the controller 100 may determine whether a time when the second mixing operation is performed exceeds a third set time. For example, the third set time may be set to 5 minutes.

Figure 7:
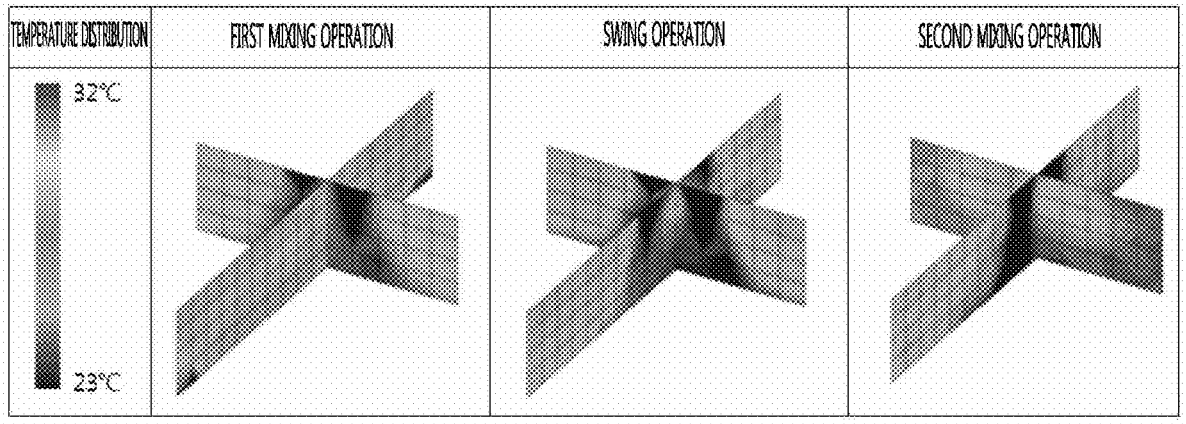
FIG. 7 is an experimental graph showing airflow discharged when cooling operation of FIG. 5 is performed.

According to the second mixing operation, air discharged from the first vane group 81 and 83 may form vertical airflow flowing toward the floor surface of the indoor space (see FIG. 7) and air discharged from the second vane group 82 and 84 may flow toward the walls located in the forward-and-backward direction of the indoor space along the ceiling surface to form horizontal airflow (see FIG. 7). The forward-and-backward direction may be understood as a direction perpendicular to the sidewall direction of the first mixing operation.

Accordingly, in the second mixing operation, the dead zone of the first mixing operation and the swing operation can be eliminated by mixing the horizontal airflow flowing along the walls located in the forward-and-backward direction of the indoor space and the vertical airflow spreading from the center of the floor surface of the indoor space in the lateral direction. Therefore, airflows provided by the air conditioner 10 are rapidly mixed and the indoor temperature of the indoor space may be rapidly decreased.

In another aspect, the first mixing operation S120 and the second mixing operation S140 may be understood as operation in which the first vane group 81 and 83 and the second vane group 82 and 84 are positioned at different rotation angles to generate the horizontal airflow or the vertical airflow.

When the third set time has elapsed, the air conditioner 10 may perform return operation (S150).

Specifically, in the return operation, the controller 10 may perform control to perform the swing operation and the first mixing operation in the reverse order.

For example, when the third set time has elapsed, the controller 100 may perform control such that the swing operation is performed for the second set time. Accordingly, the first vane group 81 and 83 and the second vane group 82 and 84 may continuously rotate between the first angle group P1 and the third angle group P3.

Thereafter, when the third set time has elapsed again, the controller 100 may perform control such that the first mixing operation is performed. Accordingly, the first vane group 81 and 83 may rotate in the first angle group P and the second vane group 82 and 84 in the third angle group P3 to guide air discharged through the outlet 22 for the first set time.

According to the return operation, the temperature of a position where the temperature rises due to outdoor air or ventilation during the second mixing operation is decreased again. Therefore, it is possible to rapidly decrease the entire indoor temperature.

Thereafter, when the first set time has elapsed again, the dynamic airflow mode may be finished.

That is, the air conditioner 10 may perform the first mixing operation, the swing operation, the second mixing operation, the swing operation and the first mixing operation in this order, thereby generating dynamic airflow.

Therefore, since the temperature of the indoor space where the air conditioner 10 is installed can be decreased without the dead zone, it is possible to reduce the time required to reach the set temperature.

Meanwhile, even upon determining that the heating operation is performed in step S110, the air conditioner 10 may perform the first mixing operation S120.

Specifically, when the first mixing operation is performed, the controller 100 controls the first vane group 81 and 83 in the first angle group P1 and controls the second vane group 82 and 84 in the fourth angle group P4.

Meanwhile, since warm air forms ascending airflow in an indoor environment in which heating operation is performed, in the first mixing operation, the second vane group 82 and 84 may be controlled in the fourth angle group P4 in which air is further guided downward than the third angle group P3, thereby more rapidly decreasing the indoor temperature.

Similarly to the case of determining that the cooling operation is performed, in the first mixing operation, air guided by the first vane group 82 and 84 forms horizontal airflow and air guided by the second vane group 82 and 84 forms vertical airflow.

The horizontal airflow and the vertical airflow are mixed by an indoor structure (a wall surface, etc.). For example, as the horizontal airflow flowing along both walls of the indoor space and the vertical airflow flowing from the center of the floor surface in the radial direction are mixed, the indoor temperature may increase (see FIG. 8).

Thereafter, similarly to the case of determining that the cooling operation is performed, the air conditioner 10 may perform the first mixing operation for the predetermined first set time (S125).

When the first set time has elapsed, the air conditioner 10 may perform fixing operation (S130).

Specifically, when the fixing operation is performed, the controller 10 may control the first vane group 81 and 83 and the second vane group 82 and 84 in the second angle group P2. That is, in the fixed operation S160, the first vane group 81 and 83 and the second vane group 82 and 84 may be located to have the same rotation angle P2 to guide air.

As described above, the environmental conditions when heating is necessary in the indoor space are different from the environmental conditions when cooling is necessary. Specifically, when the swing operation is performed in an indoor environment requiring heating, relatively warm air rises and the temperature of a space where the user is located is relatively lowered. That is, a time required for the temperature of a user activity area to reach the set temperature may be increased.

Accordingly, if heating is necessary in an indoor space, the fixing operation in which all the discharge vanes 80 are located in the second angle group P2 may be performed after the first mixing operation.

That is, the air conditioner 10 may determine whether cooling operation or heating operation is performed and perform the swing operation or the fixing operation.

In other words, after the first mixing operation, the air conditioner 10 may perform a step of determining swing operation or fixing operation. The air conditioner 10 performs swing operation in the cooling operation and performs fixing operation in the heating operation.

In the fixing operation, the first vane group 81 and 83 and the second vane group 82 and 84 may rotate in the second angle group P2 to guide air discharged through the outlet 22 downward.

According to the fixing operation, since warm air is continuously provided toward the floor surface of the indoor space, the temperature of the lower side of the indoor space where the user is located may be concentratively increased. That is, the temperature of the user activity area can rapidly increase.

In addition, according to the fixing operation, it is possible to relatively uniformly form a vertical temperature distribution of the floor surface and the ceiling surface.

The air conditioner 10 may perform the fixing operation for a predetermined second set time (S135).

Meanwhile, in the fixing operation, when the rotation angles of the first vane group and the second vane group are set to the third angle group P3 instead of the second angle group P2, the components of the vertical airflow may increase, but mixing efficiency of airflow may deteriorate by the components of the horizontal airflow which becomes relatively insufficient.

As a result, when the fixing operation is performed in the third angle group P3, the vertical temperature difference of the indoor space (upward-and-downward-direction) is greater than that of the case of performing the fixing operation in the second angle group P2 by 1° or more, thereby causing the draft phenomenon. In this case, since the temperature distribution of vicinity of the floor surface is formed to have a relatively large deviation, it is difficult to rapidly give the user the present feeling.

Accordingly, in the fixing operation, the rotation angle of the discharge vane 80 may be set to the second angle group P2.

A dead zone in which the temperature relatively slowly increases as compared to the other indoor space may be formed by the first mixing operation and the fixing operation.

That is, in order for the temperature of the dead zone which is not covered by the first mixing operation and the fixing operation to rapidly reach a set temperature, when the second set time has elapsed, the air conditioner 10 may perform second mixing operation (S140).

Specifically, when the second mixing operation is performed, the controller 100 controls the first vane group 81 and 83 in the fourth angle group P4 and controls the second vane group 82 and 84 in the first angle group P1.

In the second mixing operation, the first vane group 81 and 83 may be located in the fourth angle group P4 to guide air discharged through the outlet 22 downward toward the floor surface, thereby forming the vertical airflow. The second vane group 82 and 84 may be located in the first angle group P1 to guide air discharged through the outlet 22 to become close to the ceiling surface in the forward-and-backward direction, thereby forming the horizontal airflow.

According to the second mixing operation (S140), the first vane group 81 and 83 and the second vane group 82 and 84 guide air in a state in which the rotation angles in the first mixing operation are exchanged with each other, thereby eliminating the dead zone. That is, the indoor temperature of the dead zone which is not covered by the first mixing operation and the swing operation may rapidly increase through the second mixing operation.

The air conditioner 10 may perform the second mixing operation for a predetermined third set time (S145).

Figure 8:
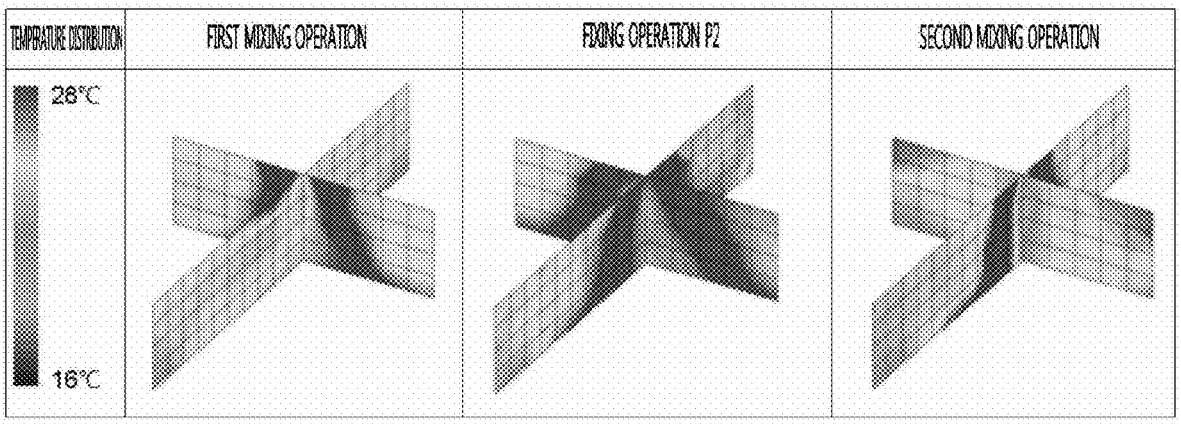
FIG. 8 is an experimental graph showing airflow discharged when heating operation of FIG. 5 is performed.

According to the second mixing operation, air discharged from the first vane group 81 and 83 may form vertical airflow descending toward the floor surface of the indoor space (see FIG. 8) and air discharged from the second vane group 82 and 84 may flow toward the walls located in the forward-and-backward direction of the indoor space along the ceiling surface to form horizontal airflow (see FIG. 8). Accordingly, in the second mixing operation, the dead zone of the first mixing operation and the swing operation can be eliminated by mixing the horizontal airflow flowing along the walls located in the forward-and-backward direction of the indoor space and the vertical airflow spreading from the center of the floor surface of the indoor space in the lateral direction. Therefore, airflows provided by the air conditioner 10 are rapidly mixed and the indoor temperature of the indoor space may be rapidly increased.

Thereafter, the air conditioner 10 may perform return operation for performing the fixing operation and the first mixing operation in the reverse order (S150).

When the return operation is performed, the controller 100 may perform the fixing operation for a second set time and then perform the first mixing operation during a first set time.

FIG. 7 is an experimental graph showing airflow discharged when cooling operation of FIG. 5 is performed, FIG. 8 is an experimental graph showing airflow discharged when heating operation of FIG. 5 is performed, FIG. 9 is a table showing an experimental result of comparing general auto swing with a dynamic airflow mode in cooling operation of a ceiling type air conditioner according to the embodiment of the present invention, and FIG. 10 is a table showing an experimental result of comparing general auto swing with a dynamic airflow mode in heating operation of a ceiling type air conditioner according to the embodiment of the present invention.

Referring to FIGS. 7 and 9, it can be seen that, in the first mixing operation performed for the first set time during the cooling operation, air discharged from the first vane group 81 and 83 flows toward walls located at both sides of the indoor space along the ceiling surface to form horizontal airflow and air discharged from the second vane group 82 and 84 flows toward the center of the floor surface of the indoor space to vertical airflow.

Accordingly, in the first mixing operation, the horizontal airflow flowing along both sidewalls of the indoor space and the vertical airflow descending toward the center of the floor surface of the indoor space and spreading in a radial direction may be mixed.

In the swing operation performed for the second set time after the first mixing operation, it can be seen that the mixing range of the vertical airflow flowing toward the floor surface and the horizontal airflow flowing in the bilateral directions is widened.

When a vertical line drawn from the ceiling surface in which the air conditioner 10 is installed toward the floor surface is defined as a central axis, it can be seen that the mixing range extends from the central axis in the circumferential direction. Accordingly, airflow can be initially concentrated to the center of the indoor space, thereby rapidly decreasing the indoor temperature.

In the second mixing operation performed for a third set time after the swing operation, since the first vane group 81 and 83 and the second vane group 82 and 84 are located perpendicularly to each other, it can be seen that the horizontal airflow and the vertical airflow of the second mixing operation are formed in the direction perpendicular to the horizontal airflow and the vertical airflow of the first mixing operation.

That is, it can be seen that air discharged from the first vane group 81 and 83 forms vertical airflow flowing to the floor surface of the indoor space and air discharged from the second vane group 82 and 84 forms horizontal airflow flowing toward to the walls located in the forward-and-backward direction of the indoor space along the ceiling surface.

In addition, since the temperature distribution is improved by the second mixing operation, the dynamic airflow mode according to the embodiment of the present invention can eliminate the dead zone.

As a result, referring to the horizontal (0.1 m or 1.1 m) temperature distribution, when the dynamic airflow mode is performed using the dual discharge vanes, it is possible to guide the discharged air in various directions as compared to conventional auto swing from a minimum angle to a maximum angle, thereby minimizing the dead zone.

In summary, the air conditioner 10 may further facilitate mixing of the horizontal airflow and the vertical airflow in the indoor space by the first mixing operation, the swing operation and the second mixing operation and further increase a mixing range, such that the indoor temperature is rapidly decreased.

In addition, the air conditioner 10 may further increase the mixing range of the horizontal airflow and the vertical airflow, thereby rapidly decreasing the indoor temperature. That is, the air conditioner 10 may enable the indoor temperature to rapidly reach the target set temperature.

Referring to FIG. 9, it is possible to confirm the cooling effect of the indoor space by the dynamic airflow of the air conditioner 10 according to the embodiment of the present invention. Here, as the experimental condition, when the outdoor temperature is 35° C., an initial indoor temperature is 33° C., and the fan rotation speed is 600 (RPM), the set temperature of the air conditioner is set to 26° C.

In the air conditioner 10 according to the embodiment of the present invention, it takes 10 minutes and 31 seconds to decrease the indoor temperature by 1° C. and takes 19 minutes and 02 seconds to reach the set temperature.

In contrast, it can be seen that, when the conventional auto swing is applied, it takes 10 minutes and 45 seconds to decrease the indoor temperature by 1° C. and takes 22 minutes and 40 seconds to reach the set temperature.

That is, according to the dynamic airflow mode of the air conditioner 10 according to the embodiment of the present invention, since a time required for the indoor temperature to reach the set temperature is reduced, it is possible to rapidly give the user a pleasant feeling.

Meanwhile, referring to FIGS. 8 and 10, in the heating operation performed under a relatively low indoor temperature condition, an airflow temperature distribution different from that of the cooling operation may be confirmed.

In particular, referring to FIG. 10, it can be seen that, when the fixing operation is performed, the indoor temperature can be rapidly increased starting from the center of the lower portion of the indoor space as warm air is continuously guided downward by the discharge vane 80.

Specifically, as the experimental condition, when the outdoor temperature is 7° C., an initial indoor temperature is 12° C., and the fan rotation speed is 670 (RPM), if the set temperature of the air conditioner is set to 26° C., it takes 06 minutes and 38 seconds to increase the indoor temperature by 1° C. and takes 25 minutes and 29 seconds to reach the set temperature in the air conditioner 10 according to the embodiment of the present invention.

In contrast, it can be seen that, when the conventional auto swing is applied, it takes 06 minutes and 46 seconds to increase the indoor temperature by 1° C. and takes 28 minutes and 08 seconds to reach the set temperature.

That is, according to the dynamic airflow mode of the air conditioner 10 according to the embodiment of the present invention, since a time required for the indoor temperature to reach the set temperature is reduced, it is possible to rapidly give the user a pleasant feeling.

In addition, it can be seen that the vertical and horizontal temperature distributions (0.1 m and 1.1 m) of the indoor space according to the dynamic airflow mode of the embodiment of the present invention is higher than that of the conventional auto swing and the temperature of the same point further increases.

In particular, it can be seen that a temperature difference between the floor surface to the ceiling surface is 2.3 in auto swing but is minimized to 0.7 in the dynamic airflow mode of the embodiment of the present invention. Therefore, it is possible to minimize draft.

The invention claimed is:

1. A method of controlling a ceiling type air conditioner including a panel located on a ceiling surface, a first vane group located at outlets formed at two opposing sides of four sides of the panel, a second vane group located at outlets formed at the other two opposing sides of the four sides of the panel, each of the first vane group and the second vane group including an upper discharge vane and a lower discharge vane located below the upper discharge vane and rotating along with the upper discharge vane, and a controller configured to control rotation positions of the first vane group and the second vane group, the method comprising:

performing a first mixing operation in which the first vane group guides air in a direction close to the ceiling surface to form horizontal airflow and the second vane group guides air in a direction close to a floor surface to form vertical airflow;

determining whether a swing operation of continuously rotating the first vane group and the second vane group or a fixing operation in which the first vane group and the second vane group are located at a same angle is performed; and performing a second mixing operation in which the first vane group forms the vertical airflow and the second vane group forms the horizontal airflow.

2. The method of claim 1, wherein the determining of whether the swing operation of continuously rotating the first vane group and the second vane group or the fixing operation in which the first vane group and the second vane group are located at the same angle is performed includes determining whether a cooling operation or a heating operation is performed, wherein it is determined that the swing operation is performed when the cooling operation is performed, and wherein it is determined that the fixing operation is performed when the heating operation is performed.

3. The method of claim 1, wherein each of the first vane group and the second vane group rotates in any one of a plurality of angle groups defined by a first rotation angle of the upper discharge vane and a second rotation angle of the lower discharge vane.

4. The method of claim 3, wherein the first rotation angle is defined as an angle between a virtual horizontal reference line parallel to the ceiling surface or the floor surface and the upper discharge vane, and wherein the second rotation angle is defined as an angle between the horizontal reference line and the lower discharge vane.

5. The method of claim 3, wherein the plurality of angle groups includes:

a first angle group in which the first rotation angle is set to 60° or more and less than 71.1° and the second rotation angle is set to 20° or more and less than 45.6°;

a second angle group in which the first rotation angle is set to 71.1° or more and less than 72.3° and the second rotation angle is set to 45.6° or more and less than 53°;

a third angle group in which the first rotation angle is set to 72.3° or more and less than 72.7° and the second rotation angle is set to 53° or more and less than 58°; and a fourth angle group in which the first rotation angle is set to 72.7° or more and less than 74° and the second rotation angle is set to 58° or more and less than 71°.

6. The method of claim 5, wherein, in the first mixing operation, the first vane group is located in the first angle group and the second vane group is located in the third angle group, when cooling operation is performed.

7. The method of claim 5, wherein, in the first mixing operation, the first vane group is located in the first angle group and the second vane group is located in the fourth angle group, when a heating operation is performed.

8. The method of claim 5, wherein, in the second mixing operation, the first vane group is located in the third angle group and the second vane group is located in the first angle group, when cooling operation is performed.

9. The method of claim 5, wherein, in the second mixing operation, the first vane group is located in the fourth angle group and the second vane group is located in the first angle group, when a heating operation is performed.

10. The method of claim 5, wherein the swing operation is defined as continuous rotation between the first angle group and the third angle group.

11. The method of claim 5, wherein, in the fixing operation, the first and second vane groups are located in the second angle group to guide air.

12. The method of claim 1, further comprising calculating an airflow unpleasant feeling index due to an indoor draft phenomenon.

13. The method of claim 12, wherein the air conditioner further includes a fan configured to blow air, and wherein, when the calculated airflow unpleasant feeling index is greater than a reference value, a rotation speed of the fan decreases.

14. A ceiling type air conditioner comprising:

a panel located on a ceiling surface;

a first vane group located at outlets formed at two opposing sides of four sides of the panel;

a second vane group located at outlets formed at the other two opposing sides of the four sides of the panel; and a controller configured to control rotation positions of the first vane group and the second vane group, wherein each of the first vane group and the second vane group includes:

an upper discharge vane; and a lower discharge vane located below the upper discharge vane and rotating along with the upper discharge vane, wherein the controller sets the rotation positions to any one of a plurality of angle groups defined by a first rotation angle of the upper discharge vane and a second rotation angle of the lower discharge vane.

15. The ceiling type air conditioner of claim 14, further comprising:

a motor connector located inside the panel and coupled with a discharge motor;

a rotation link connected with the discharge motor to rotate; and a slave link coupled to one end of the rotation link, wherein the slave link is coupled to the upper discharge vane to guide rotation of the upper discharge vane.

16. The ceiling type air conditioner of claim 15, wherein the rotation link is formed to extend from a rotation center connected with the discharge motor in two directions.

17. The ceiling type air conditioner of claim 15, wherein the other end of the rotation link is coupled with the lower discharge vane.

18. The ceiling type air conditioner of claim 15, wherein the motor connector includes a stop projection protruding toward the outlets to restrict rotation of the rotation link.

* * * * *